United States Patent [19]

Porenski, Jr.

[11] Patent Number: 4,493,331

[45] Date of Patent: Jan. 15, 1985

[54] CIGARETTE FILTER

[75] Inventor: Harry S. Porenski, Jr., Louisville, Ky.

[73] Assignee: Brown & Williamson Tobacco Corporation, Louisville, Ky.

[21] Appl. No.: 404,107

[22] Filed: Aug. 2, 1982

[51] Int. Cl.[3] ..... A24D 3/04

[52] U.S. Cl. ..... 131/336; 131/338; 131/339; 131/340; 131/361; 131/362; 131/229

[58] Field of Search ..... 131/336, 338–340, 131/227–229, 361, 362

[56] References Cited

U.S. PATENT DOCUMENTS 1,926,564 9/1933 Sharp ..... 131/361
2,171,770 9/1939 Strauch ..... 131/361
3,118,451 1/1964 Rodrigue ..... 131/361

FOREIGN PATENT DOCUMENTS 0119536 7/1900 Fed. Rep. of Germany ..... 131/361

*Primary Examiner*—Vincent Millin
*Attorney, Agent, or Firm*—Charles G. Lamb

[57] ABSTRACT

A filter for a cigarette which includes a protrusion of smoke permeable material integral with and coaxially projecting from the mouth end of the filter rod. The mouth end of the filter rod surrounding the protrusion is smoke impermeable so that as the cigarette to which the filter is attached is smoked, the smoke will exit the filter rod in generally radially outward direction through the smoke permeable protrusion.

12 Claims, 7 Drawing Figures

CIGARETTE FILTER

BACKGROUND OF THE INVENTION

A. Field of the Invention

This invention relates to filters for cigarettes, and more particularly to a filter having means at the mouth end to disperse the flow of smoke in a generally radially outward direction of the filter.

B. Description of the Prior Art

Low and ultra-low tar (1 mg. to 10 mg) cigarettes typically have filters which allow a large quantity of ventilating air to be introduced into the filter to reduce the tar in the smoke stream through dilution. Furthermore, in most commercially available products, the smoke is concentrated at the center of the filter and, during smoke draw, enters the smoker's mouth in a concentrated stream from the center of the filter generally longitudinally of the filter thereby missing many of the smoker's "taste buds" resulting in the delivery of very little taste.

There have been suggested special types of filters for cigarettes wherein the filters are provided with means to alter the flow of the smoke stream passing therethrough in anticipation of improving the efficiency of the filter. U.S. Pat. No. 2,833,289 and U.S. Pat. No. 3,496,945 are examples of filters which teach the restriction of smoke flow in the filter and then mixes the smoke with ventilating air prior to exiting from the filter at the mouth end thereof. Another example is U.S. Pat. No. 2,849,005 which teaches a latent image of an emblem being formed on the exposed end of the filter which is developed by smoke passing therethrough during use. Many other examples of mixing smoke with ventilating air are known in the art, but none teach the smoke being diverted from the center of the filter as it exits the filter.

SUMMARY OF THE INVENTION

The present invention is related to filters for cigarettes, and more particularly a filter for low tar cigarettes. Further, the present invention provides a cigarette filter for dispersing the flow of smoke exiting the central portions of the filter.

More particularly, the present invention provides a filter for a cigarette comprising a filter rod fabricated of a smoke permeable material and being of generally cylindrical configuration having opposed smoke inlet and mouth ends, means rendering the mouth end of the filter rod smoke impermeable, and a protrusion of smoke permeable material integral with and coaxially projecting outwardly from the mouth end of the filter rod, the peripheral wall of the protrusion being smoke permeable.

The present invention further provides a method for making a filter for a cigarette comprising the steps of forming a generally cylinderical filter rod of smoke permeable material having opposed smoke inlet and mouth ends, forming a protrusion of smoke permeable material integral with and coaxially projecting from the mouth end of the filter rod, and rendering only the mouth end of the filter rod smoke impermeable.

BRIEF DESCRIPTION OF THE DRAWINGS

These and other advantageous features of the present invention shall become even more clear upon reference to the following description and with reference to the accompanying drawings wherein like numerals refer to like parts throughout and in which.

DESCRIPTION OF THE PREFERRED EMBODIMENT

Figure 1:
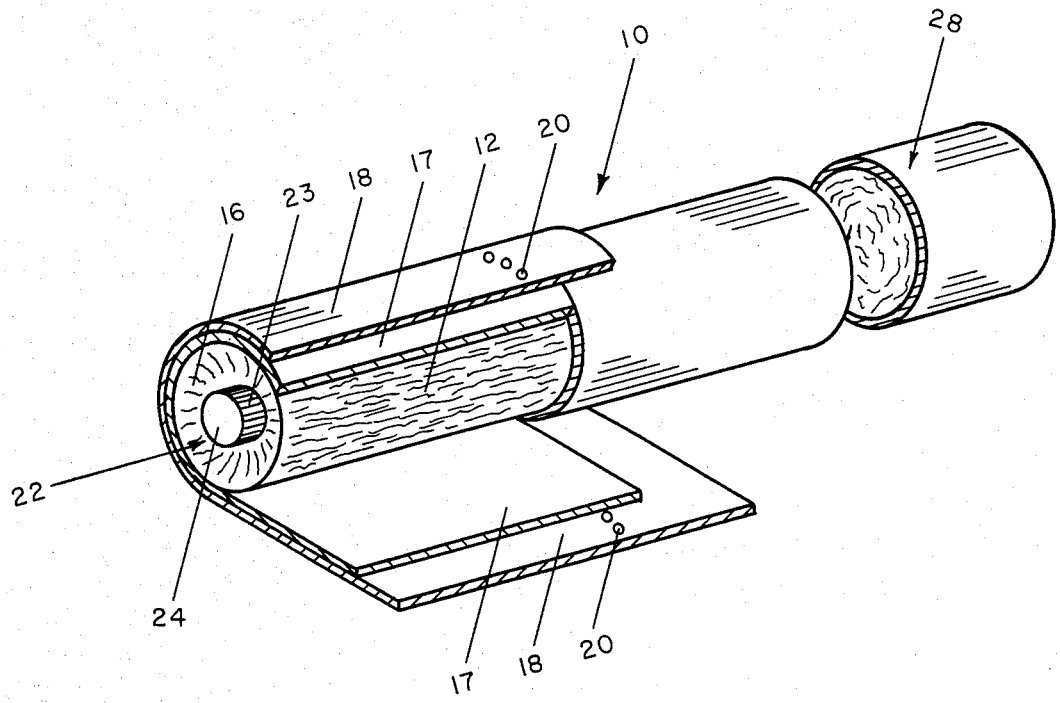
FIG. 1 is an enlarged perspective view of a cigarette filter having the features of the present invention attached to a cigarette tobacco column with the tipping material partially unwound to more clearly show details.
Figure 2:
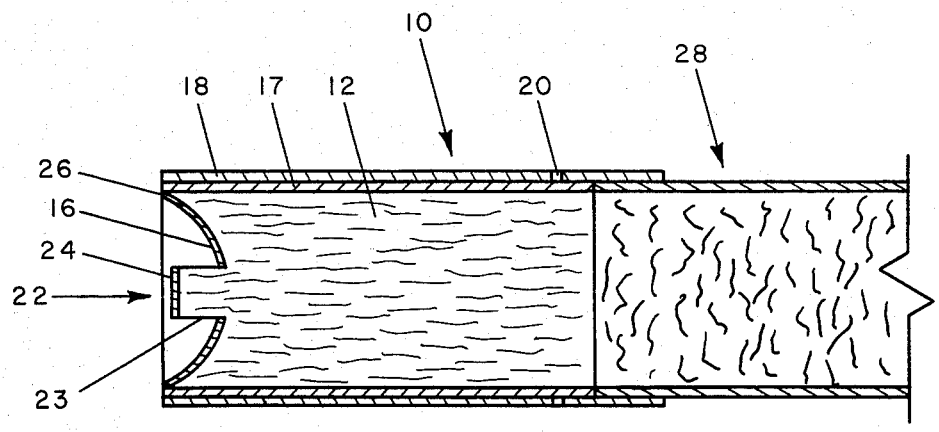
FIG. 2 is an enlarged longitudinal, cross-section of the filter of FIG. 1.

FIGS. 1 and 2 illustrate a filter, generally denoted by the numeral 10, embodying the various features of the present invention. As illustrated the filter 10 comprises a generally cylindrically configured filter rod 12 having opposed smoke inlet end 14 and mouth end 16 circumscribed by an air pervious plug wrapper 17 and air pervious tipping material 18 which circumscribes the filter rod 12.

Both the filter rod 12 and plug wrap 17 can be fabricated of virtually any porous or otherwise smoke permeable material such as, for example, fibrous or foamed cellulose acetate.

The tipping material 18 can also be of virtually any suitable material such as paper, and may be porous or as illustrated formed with a plurality of small ventilation air flow-through performations 20.

With continued reference to FIGS. 1 and 2, the mouth end 16 of the filter rod 12 is recessed and has an integral protrusion 22 of the smoke permeable material coaxially projecting outwardly from the mouth end 16. As illustrated, the recessed mouth end is generally concave in shape and is air and smoke impermeable. As shown, the protrusion 22 is generally cylindrical in configuration. The peripheral wall 23 of the cylindrical protrusion is air and smoke permeable while its projecting end 24 is air and smoke impermeable. Preferably the cylindrical protrusion 22 projects from the concave mouth end 16 of the filter rod 12 no farther than the imaginary plane of the lip 26 of the concave mouth end 16.

It should be clearly understood that the term generally cylindrical is not limited to defining a right circular cylinder, but also includes other equivalent shapes such as, for example, a truncated conical shape.

The concave mouth end 16 and the projecting end 24 of the cylindrical protrusion 22 can be rendered air and smoke impermeable in any number of ways. For example, one treatment would be to apply heat to the concave mouth end 16 and projecting column end 24 to heat seal the permeable material. Another effective treatment is to coat the concave mouth end 16 and projecting column end 24 with a chemical such as a water insoluble material, for example ethycellulose, or a water-soluble material such as, for example, Sodium CMC or methycellulose which seals the permeable material.

Figure 3:
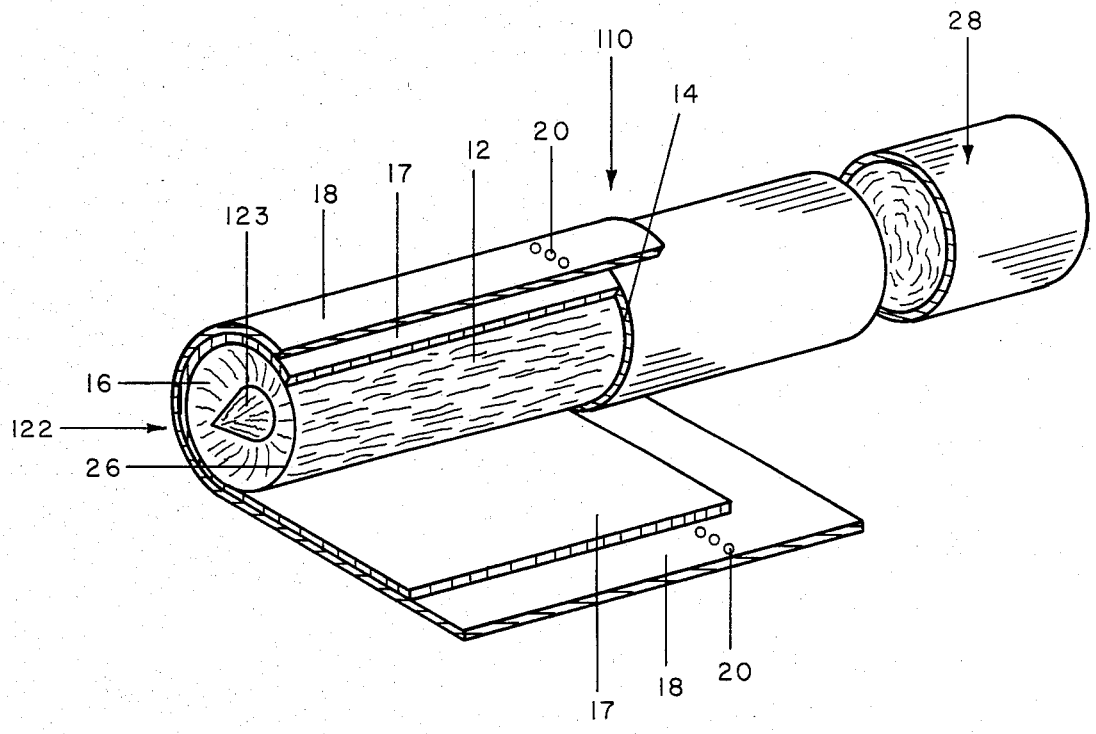
FIG. 3 is an enlarged perspective view of another cigarette filter having the features of the present invention attached to a cigarette tobacco column with the tipping material partially unwrapped to more clearly show details.
Figure 4:
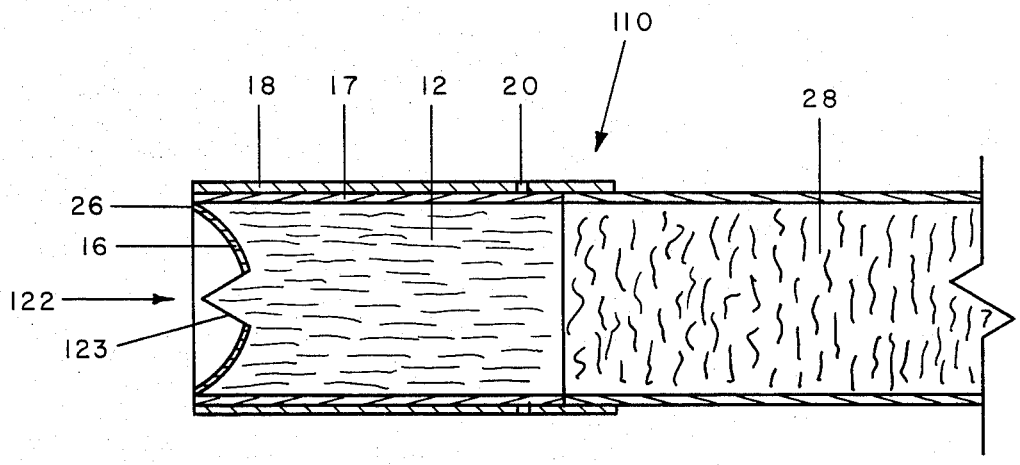
FIG. 4 is an enlarged longitudinal cross-section of the filter of FIG. 3.

FIGS. 3 and 4 illustrate a filter, generally denoted by the numeral 110, which is identical in every respect to the filter 10 illustrated in FIGS. 1 and 2, except for the configuration of the protrusion projecting coaxially from the recessed mouth end 16 of the filter rod 12. As shown in FIGS. 3 and 4, the protrusion, here denoted as the number 122, is generally conical in configuration. As with the generally cylindrical protrusion 22, the peripheral wall 123 of the generally conical protrusion 122 is air and smoke permeable.

It should be understood that the term generally conical includes such other configurations as for example, a pyramid shape.

The size of the permeable area of the peripheral wall of the protrusions 22, 122 is a function of the pressure drop required to obtain a desired amount of draw effort as a cigarette is smoked, and also a function of the filtration efficiency to be obtained. These design criteria are variable and, therefore, the permeable area of the peripherial wall of the protrusion can be sized to suit.

With reference to FIGS. 1 through 4, the filter rod 12 is attached to a tobacco column 28 by the tipping material 18 which circumscribes the filter rod 12 and overlaps the tobacco column 28.

When a smoker draws on the mouth end 16 of the filter 10, 110 while smoking the cigarette, ventilation air is drawn through the perforations 20 of the tipping material 18, through the plug wrapping 17 and into the filter rod 12 wherein it mixes with and dilutes the smoke flowing through the filter rod from the tobacco column 28 as it travels to the mouth end 16 of the filter rod. The diluted smoke leaves the filter rod 12 through the air and smoke permeable peripheral wall of the protrusions 22, 122 in a generally radially outward direction of the filter and into the space defined by the recessed mouth end 16. The wall of the concave mouth end 16 adds in dispersing the smoke outwardly into the smoker's mouth.

Figure 5:
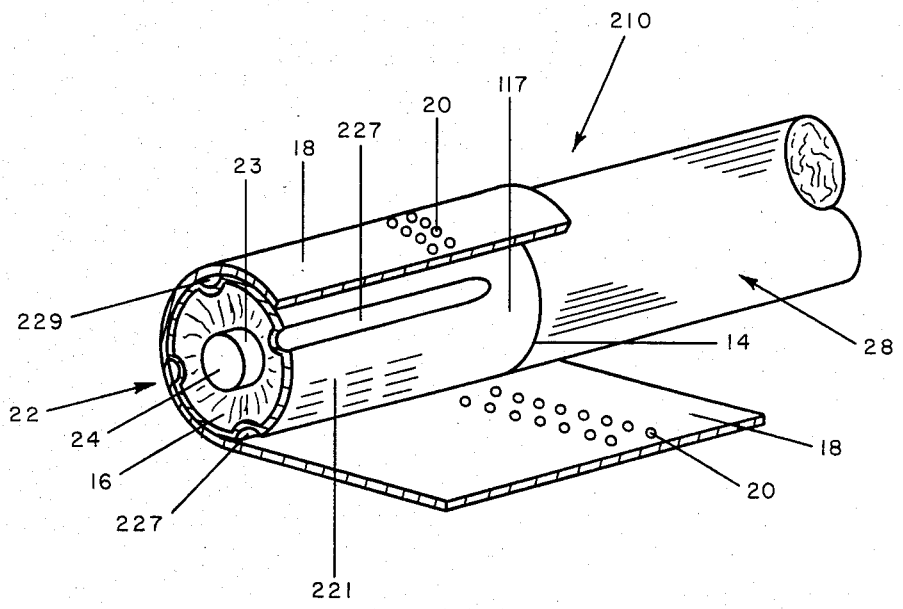
FIG. 5 is an enlarged perspective view of yet another filter having the features of the present invention attached to a cigarette tobacco column with the tipping material partially unwound to more clearly show details.
Figure 6:
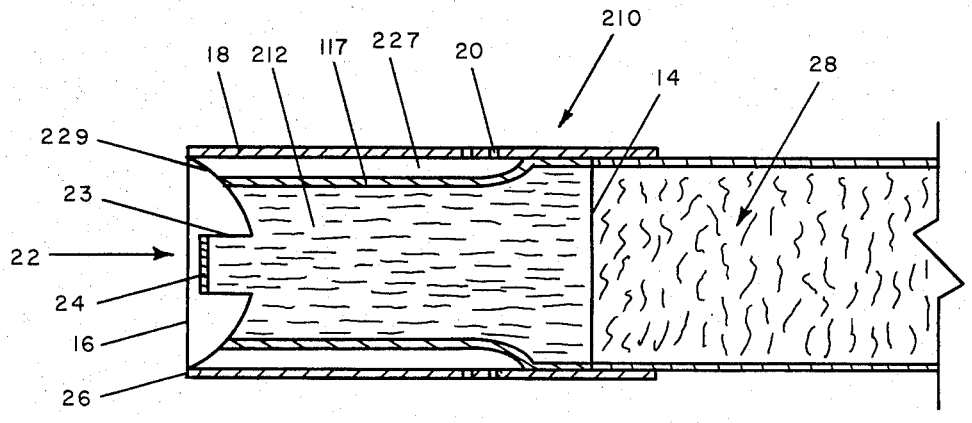
FIG. 6 is an enlarged longitudinal cross-section of the filter of FIG. 6.

FIG. 5 and 6 illustrate a filter 210 comprising a generally cylindrically configured filter rod 212 having opposed smoke inlet end 14 and mouth end 16 circumscribed by an air impervious plug wrapper 117 and air pervious tipping material 18 which circumscribes the filter rod 212.

As with the filters 10 and 110, the mouth end 16 of the filter rod 212 is recessed and has an integral protrusion 22 of the smoke permeable material coaxially projecting outwardly from the mouth end 16. While the filter 210 is shown as including the generally cylindrical protrusion 22, it should be clearly understood that the filter 210 could include the generally conical protrusion 122.

With continued reference to FIGS. 5 and 6, the filter 210 further comprises a plurality of grooves 227 formed in the air impervious plug wrapper 117 and embedded into the filter rod 212. Each of the grooves 227 is open at one of its ends 229 to the mouth end 16 of the filter rod 212 of the filter 210, and extends therefrom in a generally longitudinal direction of the filter rod 212 for a distance less than the length of the filter rod 212.

As shown in FIGS. 5 and 6, four grooves 227 are equally spaced from each other around the circumference of the filter rod 212.

The wrapped filter rod 212 is attached to a tobacco column 28 by the tipping material 18 which circumscribes the filter rod 212, with the air flow perforations 20 in communication with the grooves 227 of the filter rod 212, and overlaps the tobacco column 28 to form a filter cigarette.

When a smoker draws on the mouth end 16 of the filter 210 while smoking the cigarette, ventilation air will be drawn through the perforations 20 of the tipping material 18 into the grooves 227. Ventilating air will not flow into the body of the filter rod 212 due to the air impervious wrapper 117, and likewise, smoke will not flow from the body of the filter rod 212 into the grooves 227. Therefore, only ventilating air will flow in the grooves 227. The smoke leaves the filter rod 212 through the permeable peripheral wall of the protrusion 22, 122 in a generally radially outward direction of the filter and into the space defined by the recessed mouth end 16.

The wall of the concave mouth end 16 aids in dispersing the smoke outwardly into the smoker's mouth. Furthermore, at least a portion of the smoke leaving the mouth end of the filter will intersect the ventilating air stream issuing from the open ends 229 of the grooves 227 at the mouth end 16 of the filter 210. The ventilating air stream will dilute the smoke as well as cause turbulence in the smoke further aiding in the dispersion of the smoke into the smoker's mouth.

Figure 7:
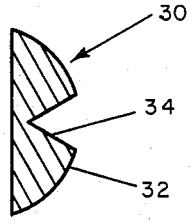
FIG. 7 is a cross-sectioned side view of an exemplary tool for making a filter embodying the features of the present invention.

FIG. 7 illustrates an example of one tool 30 which can be used to make the filter 10, 110 and 210. The tool 30 is formed with a convex surface 32 complementary to the concave mouth end 16 to be formed in the filter rod 12. The tool 30 is also formed with a blind end bore 34 coaxial with and open to the convex surface 32. The blind end bore 34 is complementary in size and shape to the protrusion 22, 122 to be formed. The tool can be heated by, for example, electrical resistance if the filter rod material has such a modulus of elasticity as not to take a set if cold formed, or if it is desired to heat seal the concave mouth end concurrently with the formation thereof. The tool 30 is pressed against the mouth end 16 of the filter rod embedding the convex surface 32 therein and concurrently extruding the filter rod material into the bore 34.

The foregoing detailed description of the present invention is given primarily for clearness of understanding and no unnecessary limitations should be understood therefrom for modifications will become obvious to those skilled in the art upon reading the disclosure and may be made without departing from the spirit of the invention or scope of the appended claims.

The invention claimed is:

1. A filter for a cigarette comprising:

a filter rod fabricated of a smoke permeable material and being of generally cylindrical configuration having opposed smoke inlet and outlet ends;

said mouth end including a protrusion integral with and in smoke flow communication with the smoke permeable material and coaxially projecting outwardly from said filter rod, the peripheral wall of said protrusion being smoke permeable, the remaining portion of said mouth end of said filter rod being impermeable.

2. The filter defined in claim 1 wherein the outlet end of said filter rod is recessed.

3. The filter defined in claim 2 wherein said protrusion projects from said recessed outlet end of said filter rod no farther than the plane of the lip of the concave outlet end.

4. The filter defined in claim 2 wherein said recessed outlet end is generally concave in shape.

5. The filter defined in claim 1 wherein said protrusion is of generally cylindrical configuration.

6. The filter defined in claim 5 further comprising means rendering the projecting end of said cylindrically configured protrusion smoke impermeable.

7. The filter defined in claim 1 wherein said protrusion is of generally conical configuration.

8. The filter defined in claim 1 further comprising air pervious tipping material circumscribing said filter rod.

9. The filter defined in claim 1 further comprising an air pervious wrapper circumscribing said filter rod.

10. The filter defined in claim 1, further comprising at least one groove formed in said filter rod, said at least one groove being open at the mouth end of said filter rod and extending therefrom in a generally longitudinal direction of said filter rod for a distance less than the length of said filter rod.

11. The filter defined in claim 1, further comprising an air impervious wrapper circumscribing said filter rod.

12. The filter defined in claim 11, further comprising at least one groove formed in said filter rod, said at least one groove being open at the mouth end of said filter rod and extending therefrom in a generally longitudinal direction of said filter rod for a distance less than the length of said filter rod.

* * * * *